United States Patent [19]

Nelson

[11] 4,112,988

[45] Sep. 12, 1978

[54] FASTENER HOLDING ATTACHMENT FOR A TOOL

[76] Inventor: Karl L. Nelson, 3870 Manitoba Ave., Powell River, British Columbia, Canada, V8A 2W4

[21] Appl. No.: 777,707

[22] Filed: Mar. 15, 1977

[51] Int. Cl.[2] ..... B25B 15/00

[52] U.S. Cl. ..... 145/50 D; 24/16 PB; 145/52

[58] Field of Search ..... 145/50 D, 52, 50 DB; 24/16 PB

[56] References Cited

U.S. PATENT DOCUMENTS

| | | | |
|---|---|---|---|
| 1,945,932 | 2/1934 | Caley | 24/16 PB |
| 2,201,139 | 5/1940 | Ivey | 24/16 PB X |
| 2,211,340 | 8/1940 | Mehrkens | 24/16 PB |
| 2,361,506 | 10/1944 | Smith | 24/16 PB |
| 3,197,830 | 8/1965 | Hoadley | 24/16 PB |
| 3,224,054 | 12/1965 | Lige | 24/16 PB |

FOREIGN PATENT DOCUMENTS

| | | | |
|---|---|---|---|
| 796,222 | 1/1936 | France | 24/16 PB |
| 1,436,187 | 12/1968 | Fed. Rep. of Germany | 24/16 PB |
| 1,056,740 | 1/1967 | United Kingdom | 24/16 PB |

*Primary Examiner*—James L. Jones, Jr.
*Assistant Examiner*—J. T. Zatarga
*Attorney, Agent, or Firm*—Fetherstonhaugh & Co.

[57] ABSTRACT

A holder formed of a strip of resilient material has a center portion provided with a longitudinal slot, and opposite end portions. The end portions are connected to the shank of a tool and the center portion passes around the end of the tool allowing the fastener to pass through the longitudinal slot and thus be releasably attached to the tool.

4 Claims, 5 Drawing Figures

FASTENER HOLDING ATTACHMENT FOR A TOOL

Figure 1:
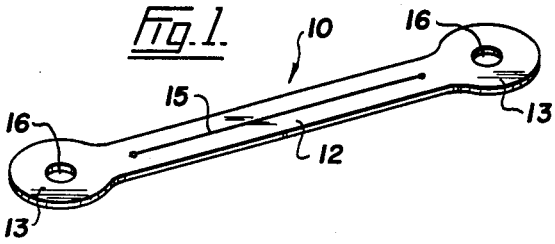

This invention relates to a device for holding a fastener to a tool.

A fastener such as a bolt normally is started into its threaded opening by hand before being tightened into position by use of the appropriate tool which often is a socket wrench. However, a mechanic will sometimes find it necessary to start the bolt in an opening located within a confined space which will not except his hand and then he must try and reach the opening with the bolt balanced on, or somehow wedged to the tool. This is so difficult to do that usually the workman will find it necessary to use a specialized tool with a fastener-holding device incorporated into its construction. The cost of such specialized tools is objected to by many workman and so is the time needed to switch from the normally-used tool to the specialized tool and to attached the fastener to the latter.

The present invention offers an effective solution to this problem by providing a very simple and inexpensive holder which can be stamped out of a strip of suitably resilient material. The holder is readily attached to both the tool and the fastener and the device will just as readily release the started fastener in response to an outward pull exerted upon the tool.

According to the present invention, there is provided a holder which comprises a resilient member including an elongated centre portion and opposite end portions, said elongated centre portion having a longitudinal slot through which the fastener projects while engaged by the fastener-engaging part, said opposite end portions each having an opening and said portions overlapping when the resilient member is wrapped around the fastener-engaging part to allow the shank of the tool to project through the substantially aligned openings, and said centre portion then releasably retaining the fastener in engagement with the fastener-engaging part.

Figure 2:
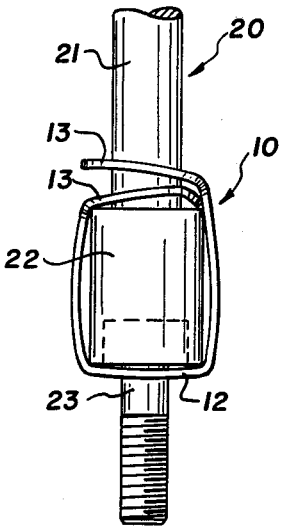
Figure 3:
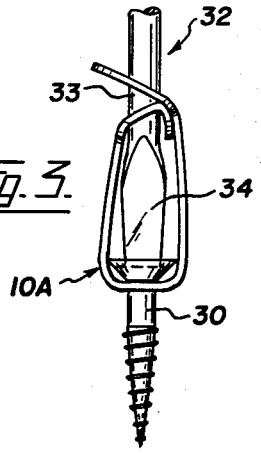
Figure 4:
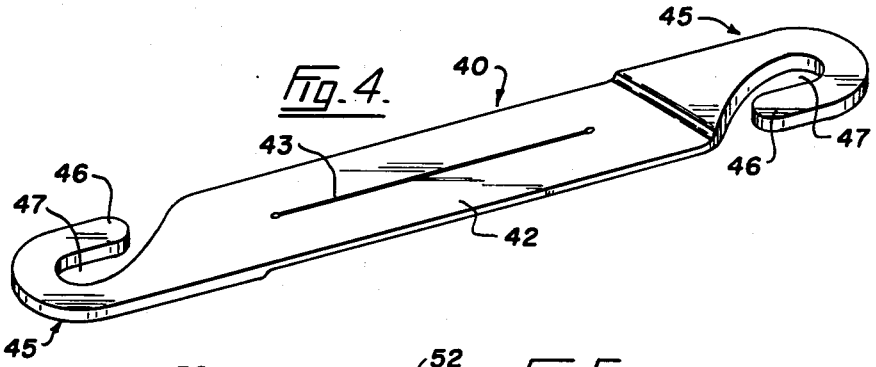
Figure 5:
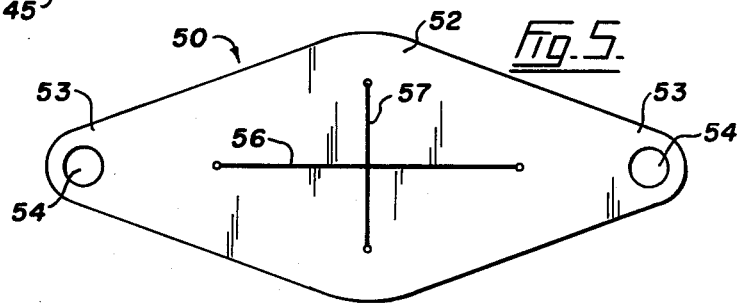

In the drawings which illustrate preferred embodiments of the invention,

FIG. 1 is a perspective view of a holder constructed in accordance with a preferred embodiment of the invention, FIGS. 2 and 3 are side elevations showing the holder attaching a bolt and a screw respectively to the tools used on such fasteners, FIG. 4 is a perspective view of another embodiment of the invention, and FIG. 5 is a plan view of still another embodiment of the invention.

Referring now to the drawings, the numeral 10 indicates generally a holder which preferably is formed of a flat strip of rubber although some plastics as well as other suitably resilient material may be used. The holder 10 has a centre portion 12 and opposite end portions 13.

The portion 12 desirably is rectangular in cross section and generally rectangular when viewed in plan as well. A narrow slot 15 is formed in the middle of the portion 12 to extend longitudinally thereof and to terminate near the end portions 13.

The portions 13 are enlarged with respect to their connecting portion 12, for example, they are shown in FIG. 1 to be partly circular. Each portion 13 has a concentric opening 16 and preferably the centres of these openings are aligned with the slot 15.

FIG. 2 shows the holder 10 in position of use upon a socket wrench generally indicated at 20. Such a tool has a shank 21 which can be fitted with a detachable socket 22 for holding a bolt 23.

When it is necessary to thread the bolt 23 into a hard-to-reach engine part or the like, the holder 10 is attached to the shank 21 with the socket 22 removed. The holder is folded upon itself so that the ends 13 overlap and the registering openings 16 are positioned over the slot 15. The end of the shank 21 is pushed through the openings and the slot to position the holder a short distance from the end of the shank whereupon the socket 22 is snapped into position on the shank end. Centre portion 12 is pushed over the socket to form the holder into a loop which encircles the socket as shown in FIG. 2. The head of the bolt 23 is then pushed through the slot 15 into the socket whereupon the resilient halves of the centre portion 12 move into gripping engagement with the bolt immediately below the bolt head.

The bolt 23 is now supported by the holder 10 so that it can be started straight down or at any angle without the bolt dropping out of the socket as it would do if not otherwise held by one hand of the workman. Once the bolt is started by turning the tool, the wrench 20 is pulled away from the bolt. This movement results in the slot 15 being momentarily spread apart by the passage of the bolt head but the centre portion 12 immediately reassumes its normal position beneath the socket. The slot 15 is again spread allowing the centre portion 12 to be moved up over the socket into a position alongside the overlapping ends 13 which remain in their original position encircling the shank 21. Now the wrench 20 can be used in a normal manner allowing the bolt 23 to be tightened by reengaging the socket 22 with the head of the fastener.

In FIG. 3, the numeral 10A indicates generally a holder similar to the one previously described but of a smaller size. Holder 10A is shown used to hold a screw 30 on a screwdriver 32. This tool has a shank 33 and a blade 34. Holder 10A is operated substantially as previously described to attach the screw 30 to the screwdriver 32 so that it can be started into the workpiece.

FIG. 4 shows another embodiment of the resilient holder which is generally indicated at 40. This flexible holder 40 has a centre portion 42 provided with a longitudinal slot 43. End portions 45 of the device are formed into hooks 46 which define openings 47. Preferably, the end portions 46 are thicker than the portion 42 so as to be relatively stiff.

The holder 40 will allow screws and bolts to be held to the tools used to apply such fasteners. Holder 40 is attached to the wrench 20, for example, while the socket 22 is still in place. The holder first is looped around the socket to overlap the ends 46 which are then hooked over the shank 21. The head of the bolt 23 is pushed through the slot 43 as before and is seated in the socket 22 whereupon the bolt 22 can be started into its threaded opening while removably attached to the tool.

Referring finally to the embodiment shown in FIG. 5, the numeral 50 indicates generally a holder formed of a flat strip of rubber having a centre portion 52 and opposite end portions 53. The holder 50 tapers inwardly from the portion 52 to the portions 53 and each of the latter portions is provided with an opening 54. A longitudinal slot 56 is formed in the holder 50 and this slot is bisected by a transverse slot 57.

Holder 50 is particularly intended for use when large-headed bolts (not shown) are to be attached to a socket wrench. The holder 50 is attached to the tool whereby to support the bolt in the same manner as the holder 10 and the slots 56 and 57 arranged as a cross allow the bolt head to pass therethrough with only appropriate holding resistance being offered by the flexible areas of the holder adjacent the slots.

I claim:

1. The combination of a tool and a fastener holder serving to start a fastener in a hard-to-reach location, said tool having a shank and a fastener-engaging part; said holder comprising a resilient member including an elongated centre portion and opposite end portions, said elongated centre portion having a longitudinal slot through which the fastener projects while engaged by the fastener-engaging part, said opposite end portions each being provided with an opening having a side edge, said side edges gripping the shank and being adjustable lengthwise thereof with the opposite end portions are overlapped above the fastener-engaging part and the resilient member wrapped around said part to allow the shank of the tool to project through the substantially aligned openings, and said centre portion then releasably retaining the fastener in engagement with the fastener-engagin part.

2. The combination as claimed in claim 1, in which said opposite end portions have greater thickness than the elongated centre portion and are shaped as hooks to define the openings.

3. The combination as claimed in claim 1, in which said centre portion has a transverse slot bisecting the longitudinal slot.

4. A method of releasably securing a fastener to a tool using a resilient member having a longitudinal slot and opposite end openings comprising the steps of:

forming the resilient member into a loop so that the longitudinal slot traverses an end of the tool to hold the fastener in engagement with the tool end and the opposite end openings engage a part of the tool remote from that end, and tensioning the resilient member to resist passage of the fastener through the longitudinal slot.

* * * * *